US009918166B2

(12) United States Patent
Wu et al.

(10) Patent No.: US 9,918,166 B2
(45) **Date of Patent: *Mar. 13, 2018**

(54) SPEAKER

(71) Applicant: AAC Technologies Pte. Ltd., Singapore (SG)

(72) Inventors: Shuwen Wu, Shenzhen (CN); Wei Song, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 9 days.

This patent is subject to a terminal disclaimer.

(21) Appl. No.: 15/082,341

(22) Filed: Mar. 28, 2016

(65) Prior Publication Data

US 2017/0048622 A1 Feb. 16, 2017

(30) Foreign Application Priority Data

Aug. 10, 2015 (CN) ..... 2015 2 0599047 U

(51) Int. Cl.

| | |
|---|---|
| ***H04R 1/00*** | (2006.01) |
| ***H04R 9/04*** | (2006.01) |
| *H04R 7/12* | (2006.01) |
| *H04R 9/06* | (2006.01) |
| *H04R 1/06* | (2006.01) |

(52) U.S. Cl.

CPC ..... *H04R 9/043* (2013.01); *H04R 1/06* (2013.01); *H04R 7/127* (2013.01); *H04R 9/06* (2013.01); *H04R 2499/11* (2013.01)

(58) Field of Classification Search

CPC . H04R 9/06; H04R 9/025; H04R 9/04; H04R 9/043; H04R 2209/022; H04R 7/12; H04R 7/16; H04R 9/046; H04R 1/025; H04R 2400/07; H04R 31/00; H04R 31/006; H04R 7/045; H04R 9/02; H04R 9/041

USPC ..... 381/400–410, 421–425, 433

See application file for complete search history.

(56) References Cited

U.S. PATENT DOCUMENTS

| | | | | |
|---|---|---|---|---|
| 2005/0241876 | A1* | 11/2005 | Sperle | H04R 1/025 181/150 |
| 2006/0188120 | A1* | 8/2006 | Fisher | H04R 9/025 381/338 |
| 2007/0071274 | A1* | 3/2007 | Andersen | H04R 1/06 381/404 |
| 2009/0200101 | A1* | 8/2009 | Baker | H04R 7/127 181/148 |
| 2011/0026831 | A1* | 2/2011 | Perronnin | G06F 17/30244 382/197 |
| 2011/0268310 | A1* | 11/2011 | Bullimore | H04R 7/26 381/398 |

(Continued)

FOREIGN PATENT DOCUMENTS

CN 102611970 A * 7/2012

*Primary Examiner* — Matthew Eason
*Assistant Examiner* — Julie X Dang
(74) *Attorney, Agent, or Firm* — Na Xu; IPro, PLLC

(57) ABSTRACT

A speaker is disclosed. The speaker includes a magnetic circuit system; a vibration system including a vibrating diaphragm, a voice coil for driving the vibrating diaphragm, and a silicone gel spider elastically supporting the voice coil. The silicone gel spider includes a through-hole passing through an upper surface and a lower surface thereof for balancing air pressure inside and outside of the speaker.

7 Claims, 2 Drawing Sheets

(56) References Cited

U.S. PATENT DOCUMENTS

| | | | | |
|---|---|---|---|---|
| 2011/0299716 | A1* | 12/2011 | Reckert | H04R 7/02<br>381/398 |
| 2013/0182885 | A1* | 7/2013 | Fujitani | H04R 3/00<br>381/412 |
| 2014/0056464 | A1* | 2/2014 | Li | H04R 9/025<br>381/400 |
| 2014/0376766 | A1* | 12/2014 | Chen | H04R 9/02<br>381/400 |

* cited by examiner

SPEAKER

FIELD OF THE DISCLOSURE

The present disclosure generally relates to electro-acoustic transducers, and more particularly to a miniature speaker.

BACKGROUND

With the rapid development of technology, audio devices are more and more popular. The people require not only the video and audio playing function of the audio devices, but also require higher reliability of audio devices. In particular incoming 3G era, mobile multimedia technologies are developed also and many audio devices have many entertainment features, such as video playing, digital camera, games, GPS navigation and so on. More sophisticated and compact electronic components are required in audio devices.

In audio devices, speaker is a common electronic component and is mainly used for playback of audio signals. In existing speaker, in order to make voice coil vibrate stably, a spider in a structure as same as the vibrating diaphragm is installed at the lower portion of the voice coil, and a confined space is created between the vibrating diaphragm and the spider, so the air inside the confined space cannot go out, thereby affecting seriously the acoustics performance of the speaker.

Therefore, it is desired to provide a new speaker which can overcome the aforesaid problem.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and an exemplary embodiment thereof.

Figure 1:
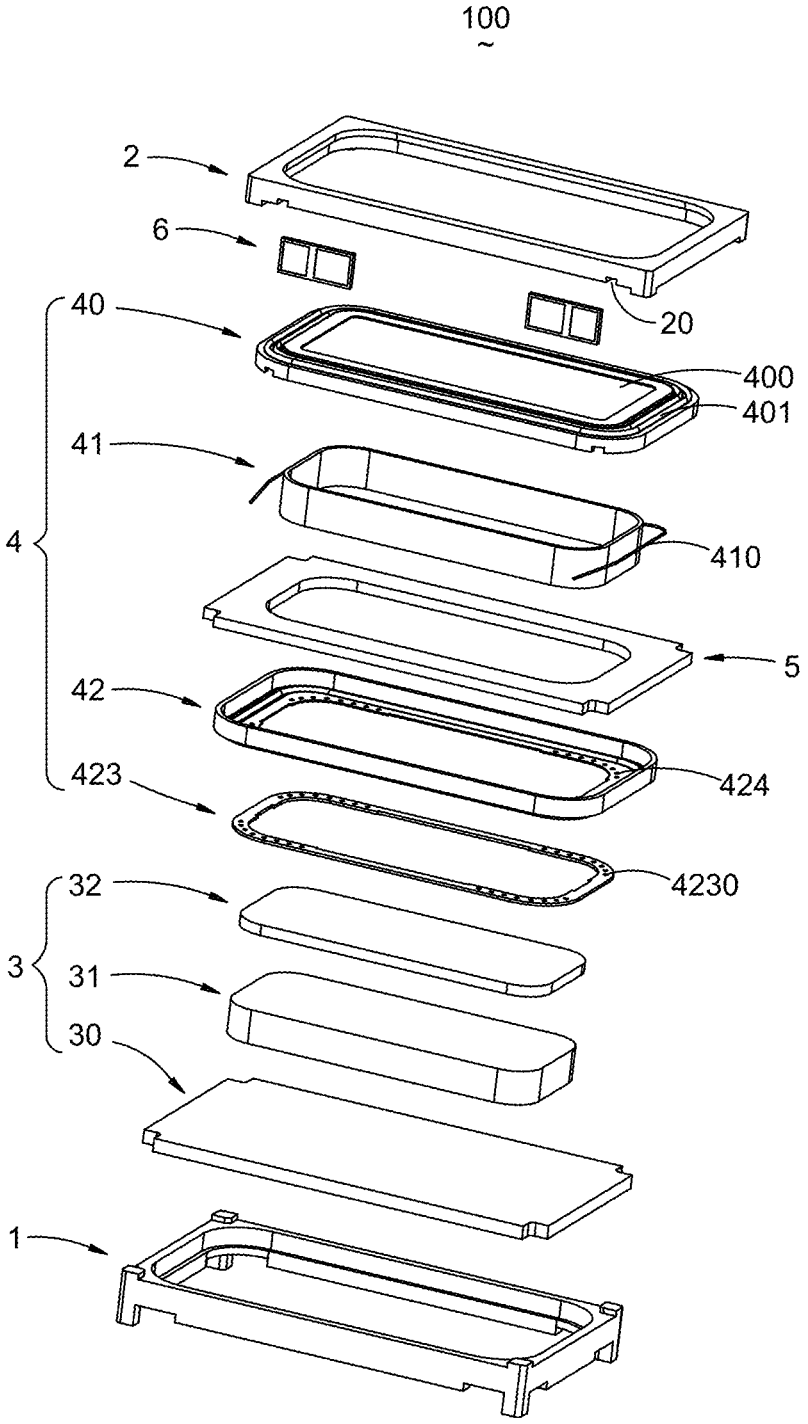
FIG. 1 is an isometric and exploded view of a speaker in accordance with an exemplary embodiment of the present disclosure.
Figure 2:
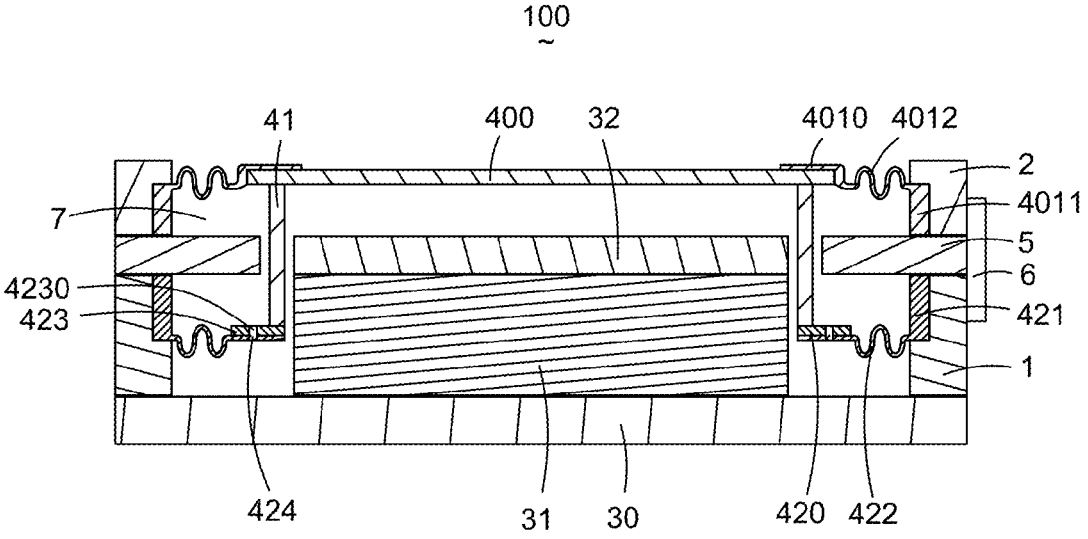
FIG. 2 is a cross-sectional view of the speaker in FIG. 1.

As shown in FIGS. 1-2, an exemplary embodiment of the present disclosure discloses a speaker 100 which comprises a frame 1, a front cover 2 which creates a receiving space together with the frame, a magnetic circuit system 3, and a vibration system 4 accommodated in the receiving space.

The vibration system 4 includes a vibrating diaphragm 40, a voice coil 41 which drives the vibrating diaphragm 40 to radiate sound waves, a silicone gel spider 42 which supports elastically the voice coil 41. The voice coil 41 is provided with upper and down ends. The upper end is fixed on the vibrating diaphragm 40 and the lower end is fixed on the silicone gel spider 42. The vibrating diaphragm 40 comprises a middle top dome 400 and a silicone gel edge ring 401 which is connected with the middle top dome 400 on a second internal circumferential part 4010. The top dome 400 is integrated with the silicone gel edge ring 401 by injection molding. The middle top dome 400 is stacked-up with the second internal circumferential part 4010. The upper end of the voice coil 41 is fixed by glue on the middle top dome 400. Preferably, the middle top dome 400 is made from aluminum and its Young's modulus is greater than that of the silicone gel edge ring 401.

The silicone gel edge ring 401 comprises a second external circumferential part 4011 which is fixed by injection molding on the front cover 2, and a second deforming part 4012 which is connected with the second internal circumferential part 4010 and a second external circumferential part 4012 for creating elastic deformation. The second deforming part 4012 is extended in form of waves along a direction vertical to the vibration direction of the voice coil 41.

The silicone gel spider 42 includes a first internal circumferential part 420 for fixing the voice coil 41. The first external circumferential part 421 which is fixed by injection molding on the frame 1, and a first deforming part 422 which is connected with the first internal circumferential part 420 and the first external circumferential part 421. The first deforming part 422 is extended in form of waves along a direction vertical to the vibration direction of the voice coil 41. A support ring 423 is fixed on the first internal circumferential part 420 between the voice coil 41 and the first internal circumferential part 420. Optionally, the support ring 423 is made from high temperature resistant polyimide.

The speaker 100 further includes a gasket 5 which is located between the front cover 2 and the frame 1.

In this disclosure, the vibrating diaphragm 40, the voice coil 41, the silicone gel spider 42 and the gasket 5 create together a cavity 7. For balancing the sound pressure inside and outside, the silicone gel spider 42 is provided with a through-hole 424 passing through the upper and lower surfaces for balancing internal and external sound pressure. Preferably, the through-hole 424 is located in the internal circumferential part 420. The support ring 423 is provided with a second through-hole 4230 which passes through the support ring 423 and communicates with the through-hole 424.

The front cover 2 is provided with a wire outgoing hole 20. The voice coil 41 comprises a voice coil wire 410 and the voice coil wire 410 is connected electrically with external part through this wire outgoing hole 20. In present embodiment, the speaker 100 includes a soldering pad 6. The voice coil wire 410 is fixed by soldering and connected electrically with the soldering pad 6. The soldering pad 6 is connected electrically to electric circuit outside.

The magnetic circuit system 3 includes a yoke 30 installed on the lower portion of the frame 1, a magnet 31 installed on the yoke 30, a pole piece 32 mounted on the magnet 31. The magnet 31 creates magnetic field around it. The voice coil 41 surrounds the magnet 31. The energized voice coil 41 interacts with the magnetic field, thereby driving the vibrating diaphragm 40 for reciprocation vibration.

In the speaker 1 disclosed herein, the silicone gel spider is provided with a through-hole 424 which passes through the upper and lower surfaces of the silicone gel spider for balancing the internal and external sound pressure, thereby improving greatly the acoustic performance of the speaker 1.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a magnetic circuit system;

a vibration system including a vibrating diaphragm, a voice coil for driving the vibrating diaphragm, a silicone gel spider elastically supporting the voice coil; wherein the silicone gel spider includes a through-hole passing through an upper surface and a lower surface thereof for balancing air pressure inside and outside of the speaker;

the silicone gel spider further includes a first internal circumferential part for fixing the voice coil at an end far away from the vibrating diaphragm, and the through-hole is located in the first internal circumferential part.

2. The Speaker as described in claim 1 further including a support ring located between the voice coil and the first internal circumferential part of the silicone gel spider, wherein a second through-hole is provided on the support ring and communicates with the through-hole of the silicone gel spider.

3. The Speaker as described in claim 2, wherein the support ring is made from polyimide.

4. The Speaker as described in claim 2 further comprising a frame receiving the magnetic circuit system and the vibration system, and a front cover assembled on the frame, wherein the silicone gel spider further comprises a first external circumferential part which is integrated by injection molding on the frame, and a first deforming part which is connected with the first internal circumferential part and the first external circumferential part for creating elastic deformation, the first deforming part extends in form of waves along a direction vertical to a vibration direction of the voice coil.

5. The Speaker as described in claim 4, wherein the vibrating diaphragm comprises a middle top dome and a silicone gel edge ring on the second internal circumferential part and connected with the middle top dome, the middle top dome is stacked-up with the second internal circumferential part, and the voice coil is fixed on the middle top dome.

6. The Speaker as described in claim 5, wherein the silicone gel edge ring comprises a second external circumferential part fixed on the front cover, and a second deforming part connected with the second internal circumferential part and the second external circumferential part for creating elastic deformation, the second deforming part extends in form of waves along a direction vertical to the vibration direction of the voice coil.

7. The Speaker as described in claim 1 further including a front cover provided with a wire outgoing hole, wherein the voice coil comprises a voice coil wire connected electrically with an external circuit through the wire outgoing hole.

* * * * *